US010490932B1

(12) United States Patent
Schneider et al.

(10) Patent No.: US 10,490,932 B1
(45) Date of Patent: Nov. 26, 2019

(54) CONNECTOR-ASSEMBLY WITH CAVITY-PLUG-RETAINER

(71) Applicant: Delphi Technologies, LLC, Troy, MI (US)

(72) Inventors: John D. Schneider, Warren, OH (US); Gregory L. Bensing, Cortland, OH (US)

(73) Assignee: Delphi Technologies, LLC, Troy, MI (US)

( * ) Notice: Subject to any disclaimer, the term of this patent is extended or adjusted under 35 U.S.C. 154(b) by 0 days.

(21) Appl. No.: 16/040,642

(22) Filed: Jul. 20, 2018

(51) Int. Cl.
*H01R 13/58* (2006.01)
*H01R 24/28* (2011.01)
*H01R 107/00* (2006.01)

(52) U.S. Cl.
CPC ..... *H01R 13/582* (2013.01); *H01R 24/28* (2013.01); *H01R 2107/00* (2013.01)

(58) Field of Classification Search
CPC ..... H01R 13/58; H01R 13/5816; H01R 13/5221; H01R 13/5205
See application file for complete search history.

(56) References Cited

U.S. PATENT DOCUMENTS 5,634,807 A * 6/1997 Saito ..... H01R 13/5208 439/275
5,720,629 A * 2/1998 Self, Jr. ..... H01R 13/5208 439/274
6,179,657 B1 * 1/2001 Murakami ..... H01R 13/5205 439/587
6,341,983 B1 * 1/2002 Crawford ..... H01R 13/521 439/275
6,494,731 B1 * 12/2002 Suzuki ..... H01R 13/5208 439/275
7,285,014 B2 * 10/2007 Castaldo ..... H01R 13/5205 439/587
8,662,921 B2 * 3/2014 Kataoka ..... H01R 13/443 439/148
9,685,731 B2 * 6/2017 Chonan ..... H01R 13/5205
10,044,132 B2 * 8/2018 Gagnon ..... F16J 15/06
2011/0171856 A1 * 7/2011 Tyler ..... H01R 13/443 439/607.52

(Continued)

*Primary Examiner* — Briggitte R. Hammond
(74) *Attorney, Agent, or Firm* — Robert J. Myers

(57) ABSTRACT

A connector-assembly includes a connector-housing, one or more cavity-plugs, and a strain-relief-device. The connector-housing defines a plurality of cavities configured to retain a plurality of electrical-terminals inserted along a longitudinal-axis of the connector-housing. The plurality of electrical-terminals are attached to cables extending beyond a wire-end of the connector-housing. The one or more cavity-plugs are individually disposed into a portion of the plurality of cavities. The one or more cavity-plugs are configured to inhibit contamination from entering the portion of the plurality of cavities. The strain-relief-device is removably attached to the wire-end of the connector-housing. The strain-relief-device defines a plurality of apertures through which the cables extend. The strain-relief-device includes one or more cavity-plug-retainers disposed within a portion of the plurality of apertures that inhibit a removal of the one or more cavity-plugs from the portion of the plurality of cavities.

10 Claims, 2 Drawing Sheets

(56) References Cited

U.S. PATENT DOCUMENTS

2012/0315801 A1* 12/2012 Kwasny ..... H01R 13/582
439/695
2014/0242840 A1* 8/2014 Dang ..... H01R 13/6461
439/607.01

* cited by examiner

CONNECTOR-ASSEMBLY WITH CAVITY-PLUG-RETAINER

TECHNICAL FIELD OF INVENTION

This disclosure generally relates to a connector-assembly, and more particularly relates to a connector-assembly with a cavity-plug-retainer.

BRIEF DESCRIPTION OF DRAWINGS

The present invention will now be described, by way of example with reference to the accompanying drawings, in which.

DETAILED DESCRIPTION

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

Figure 1:
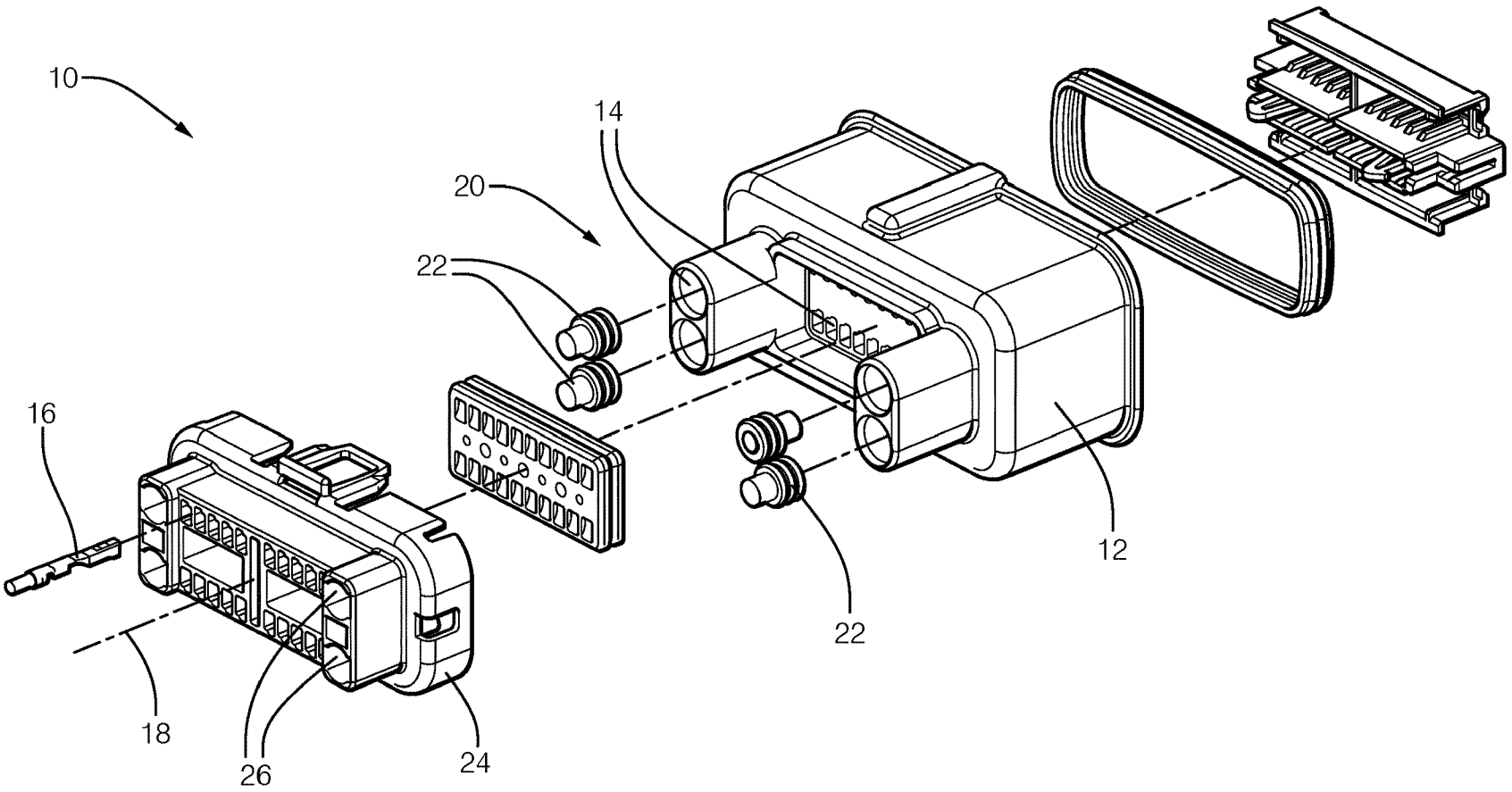
FIG. 1 is an exploded perspective view of a connector-assembly in accordance with one embodiment.

FIG. 1 is an exploded view illustrating a connector-assembly 10, hereafter referred to as the assembly 10. The assembly 10 includes a connector-housing 12 defining a plurality of cavities 14 configured to retain a plurality of electrical-terminals 16 inserted along a longitudinal-axis 18 of the connector-housing 12. The connector-housing 12 is formed of a polymeric dielectric material. The polymeric dielectric material may be any polymeric dielectric material capable of electrically isolating portions of the plurality of electrical-terminals 16, and is preferably a polyamide (NYLON) material. The plurality of electrical-terminals 16 are configured to mate with corresponding-electrical-terminals of a mating-connector (not shown). The plurality of electrical-terminals 16 are formed of an electrically conductive material, such as a copper-based alloy that may also include a coating of another conductive material (e.g. a tin-based or silver-based coating). The plurality of electrical-terminals 16 are attached to cables (not specifically shown) extending beyond a wire-end 20 of the connector-housing 12 that may be a component of a wiring-harness of a vehicle (not shown). The assembly 10 may include other components, such as seals and/or terminal-position-assurance devices (not specifically shown).

The connector-assembly 10 also includes one or more cavity-plugs 22 individually disposed into a portion of the plurality of cavities 14. The one or more cavity-plugs 22 are configured to inhibit contamination from entering the plurality of cavities 14. That is, the one or more cavity-plugs 22 seal the portion of the plurality of cavities 14 that do not retain electrical-terminals 16 and inhibit water and other environmental contaminants from entering the connector-housing 12. The one or more cavity-plugs 22 are preferably formed of a complaint material, such as a silicone rubber material, and may include a plurality or radial ribs on an outer-surface.

The connector-assembly 10 also includes a strain-relief-device 24 removably attached to the wire-end 20 of the connector-housing 12. The strain-relief-device 24 is formed of a polymeric dielectric material. The polymeric dielectric material may be any polymeric dielectric material, and is preferably a polyamide (NYLON) material. The strain-relief-device 24 defines a plurality of apertures 26 through which the cables extend (not shown) and generally protects the cables from being bent at sharp angles that mat reduce a durability of the assembly 10.

Figure 2:
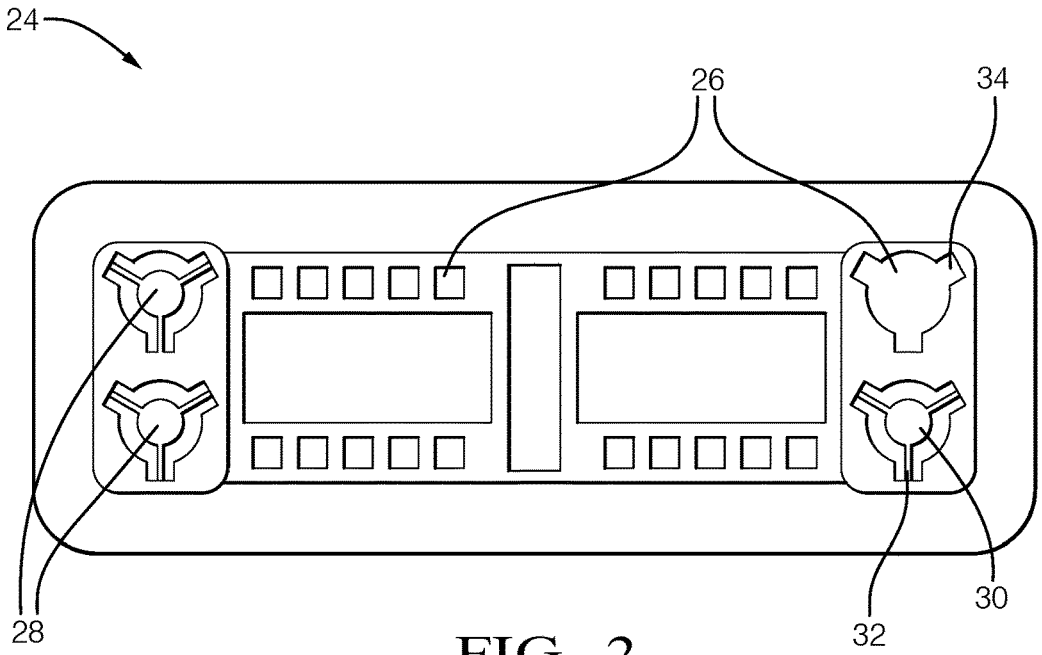
FIG. 2 is a end-view of a strain-relief-device isolated from the connector-assembly of FIG. 1. in accordance with one embodiment.

FIG. 2 is an end view of the strain-relief-device 24 isolated from the assembly 10 of FIG. 1. The strain-relief-device 24 includes one or more cavity-plug-retainers 28 disposed within a portion of the plurality of apertures 26. The one or more cavity-plug-retainers 28 are configured to inhibit a removal of the one or more cavity-plugs 22 from the portion of the plurality of cavities 14 that house the one or more cavity-plugs 22 during handling, and in-service. The one or more cavity-plug-retainers 28 are integrally formed into the strain-relief-device 24 and may be removed to make a passage for the cable. That is, the one or more cavity-plug-retainers 28 may be punched-out, or knocked-out with a tool based on an arrangement of the plurality of electrical-terminals 16 in the connector-housing 12.

Referring again to FIG. 2, the one or more cavity-plug-retainers 28 include hubs 30 (i.e. centers) suspended by a plurality of webs 32 (i.e. spokes) that radially extend from the hubs 30, and terminate within recesses 34 defined by the plurality of apertures 26. The recesses 34 are beneficial because the recesses 34 enable the removal of the cavity-plug-retainers 28 leaving no vestiges of the plurality of webs 32 behind that may negatively affect a cable-insulation of the cables that pass through the apertures 26. The hubs 30 may be suspended by any number of webs 32, and are preferably suspended by three webs 32, as illustrated in FIG. 2. The hubs 30 are characterized as having a circular-shape in a plane orthogonal to the longitudinal-axis 18, and may be of any diameter less than the diameter of the respective apertures 26.

Figure 3:
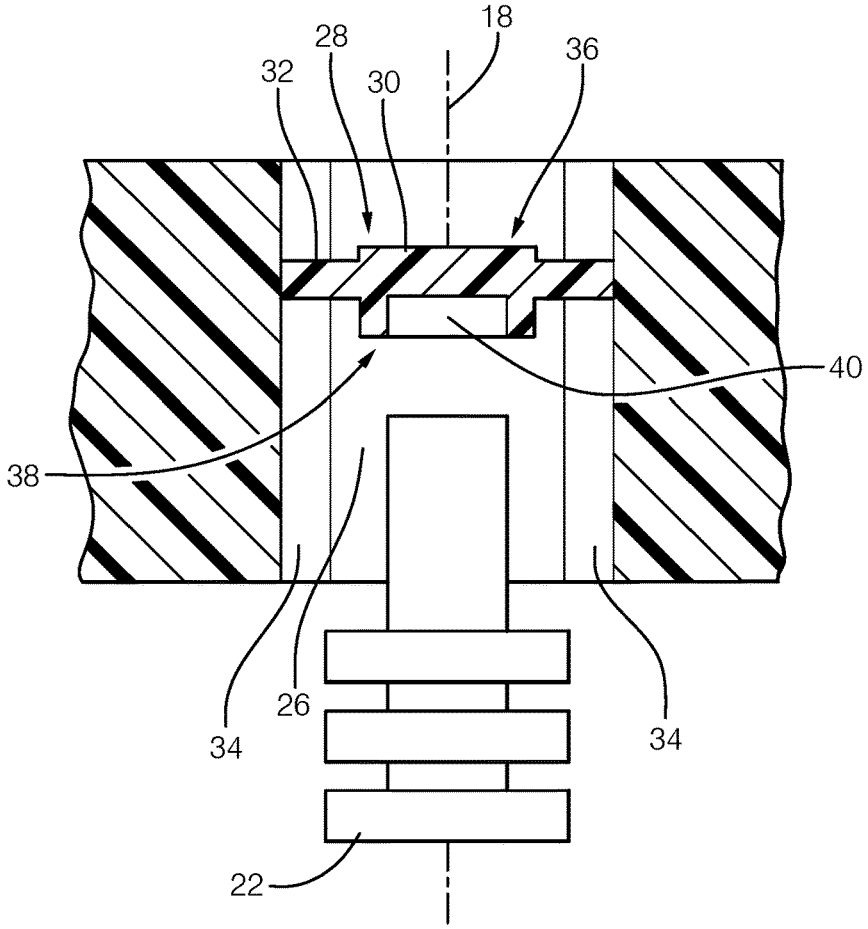
FIG. 3 is a section view of the strain-relief-device of FIG. 2 illustrating a cavity-plug-retainer in accordance with one embodiment.

FIG. 3 is a section view of one of the plurality of apertures 26 and illustrates one of the cavity-plug-retainers 28 suspended between the recesses 34. The hubs 30 include a first-surface 36 and a second-surface 38 opposite the first-surface 36, with second-surface 38 facing the one or more cavity-plugs 22. In one embodiment, the second-surface 38 defines a depression 40 configured to receive a portion of the one or more cavity-plugs 22 extending along the longitudinal-axis 18. The depression 40 has the benefit of accommodating the shape of the cavity-plugs 22 illustrated in FIG. 3. Other shapes of cavity-plugs 22 may also be retained by the cavity-plug-retainers 28.

Accordingly, a connector-assembly 10 is provided. The connector-assembly 10 is an improvement over prior art connector-assemblies because the connector-assembly 10 includes the cavity-plug-retainers 28 that inhibits the removal of the cavity-plugs 22 during handling and/or in-service.

While this invention has been described in terms of the preferred embodiments thereof, it is not intended to be so limited, but rather only to the extent set forth in the claims that follow. "One or more" includes a function being performed by one element, a function being performed by more than one element, e.g., in a distributed fashion, several functions being performed by one element, several functions being performed by several elements, or any combination of the above. It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact. The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context. Directional terms such as top, bottom, upper, lower, left, right, front, rear, etc. do not denote any particular orientation, but rather these directional terms are used to distinguish one element from another and establish a relationship between the various elements.

We claim:

1. A connector-assembly, comprising:

a connector-housing defining a plurality of cavities configured to retain a plurality of electrical-terminals inserted along a longitudinal-axis of the connector-housing, the plurality of electrical-terminals attached to cables extending beyond a wire-end of the connector-housing;

one or more cavity-plugs individually disposed into a portion of the plurality of cavities, the one or more cavity-plugs configured to inhibit contamination from entering the portion of the plurality of cavities; and a strain-relief-device removably attached to the wire-end of the connector-housing, the strain-relief-device defining a plurality of apertures through which the cables extend, the strain-relief-device including one or more cavity-plug-retainers disposed within a portion of the plurality of apertures that inhibit a removal of the one or more cavity-plugs from the portion of the plurality of cavities.

2. The connector-assembly in accordance with claim 1, wherein the one or more cavity-plug-retainers are integrally formed into the strain-relief-device.

3. The connector-assembly in accordance with claim 2, wherein the one or more cavity-plug-retainers includes hubs, the hubs suspended by a plurality of webs that radially extend from the hubs and terminate within recesses defined by the plurality of apertures.

4. The connector-assembly in accordance with claim 3, wherein the hubs include a first-surface and a second-surface opposite the first-surface, the second-surface facing the one or more cavity-plugs, the second-surface defining a depression configured to receive a portion of the one or more cavity-plugs extending along the longitudinal-axis.

5. The connector-assembly in accordance with claim 3, wherein the hubs are suspended by three webs.

6. The connector-assembly in accordance with claim 3, wherein the hubs are characterized as having a circular-shape in a plane orthogonal to the longitudinal-axis.

7. A connector-assembly, comprising:

a body configured to be removably attached to a wire-end of a connector-housing, the body defining a plurality of apertures, the body including one or more cavity-plug-retainers disposed within a portion of the plurality of apertures, the one or more cavity-plug-retainers configured to inhibit a removal of one or more cavity-plugs disposed within a portion of a plurality of cavities defined by the connector-housing, wherein the one or more cavity-plug-retainers are integrally formed into the body, wherein the one or more cavity-plug-retainers include hubs suspended by a plurality of webs that radially extend from the hubs and terminate within recesses defined by the plurality of apertures.

8. The connector-assembly in accordance with claim 7, wherein the hubs includes a first-surface and a second-surface opposite the first-surface, the second-surface configured to face one or more cavity-plugs disposed in the connector-housing, the second-surface defining a depression configured to receive a portion of the one or more cavity-plugs extending along a longitudinal-axis of the connector-housing.

9. The connector-assembly in accordance with claim 7, wherein the hubs are suspended by three webs.

10. The connector-assembly in accordance with claim 7, wherein the hubs are characterized as having a circular-shape in a plane orthogonal to a longitudinal-axis of the connector-housing.

* * * * *